US005636932A

United States Patent [19]

Kuo

[11] Patent Number: 5,636,932

[45] Date of Patent: Jun. 10, 1997

[54] LIGHT-EMITTING BALL-POINT PEN

[76] Inventor: Ming-Shish Kuo, 170 Section 2, Ming-Tsu Road, Tainan, Taiwan

[21] Appl. No.: 406,460

[22] Filed: Mar. 20, 1995

[51] Int. Cl.[6] ..... B43K 7/00; B43K 7/10; B43K 29/10

[52] U.S. Cl. ..... 401/213; 401/44; 401/47; 401/209; 401/220

[58] Field of Search ..... 401/44, 46, 47, 401/213, 216, 247, 209, 220

[56] References Cited

U.S. PATENT DOCUMENTS

| | | | |
|---|---|---|---|
| 2,660,151 | 11/1953 | Smith et al. | 401/216 |
| 3,094,105 | 6/1963 | Jenkins | 401/47 |
| 5,344,670 | 9/1994 | Palmer et al. | 427/157 |

FOREIGN PATENT DOCUMENTS

| | | | |
|---|---|---|---|
| 941875 | 1/1949 | France | 401/247 |
| 270136 | 11/1950 | Switzerland | 401/213 |
| 2243340 | 10/1991 | United Kingdom | 401/44 |

*Primary Examiner*—Steven A. Bratlie

[57] ABSTRACT

A light-emitting ball-point pen having two tubes filled with two different chemical solutions, a pen body receiving the two tubes in its interior, a steel ball fitted in a front end opening of the pen body and contacting with an outlet aperture of each of the two tubes containing a chemical solution, rotation of the steel ball forcing the chemical solutions to flow out of the outlet apertures of the two tubes, and mixing with each other to give off light during writing.

3 Claims, 3 Drawing Sheets

LIGHT-EMITTING BALL-POINT PEN

BACKGROUND OF THE INVENTION

This invention concerns a light-emitting ball-point pen, particularly one having a steel ball for wiring by means of its rotation, two chemical solutions filled in two separate tubes positioned in a pen body and flowing out with rotation of the steel ball and mixing with each other to give off light.

Conventional pens cannot give off light to see clearly what is written during the night or under dim light.

SUMMARY OF THE INVENTION

An object of this invention is to offer a light-emitting bail-point pen.

The main feature of the present invention is two chemical solutions filled in two tubes positioned in a pen body and giving off light when the two solutions are mixed with each other. The two tubes with the chemical solutions have a front end aperture abutting on a steel ball fitted in a front end opening of the pen body so that when the steel ball is rotated during writing, the two chemical solutions flow out through the apertures to mix with each other to give off light.

DETAILED DESCRIPTION OF THE INVENTION

Figure 2:
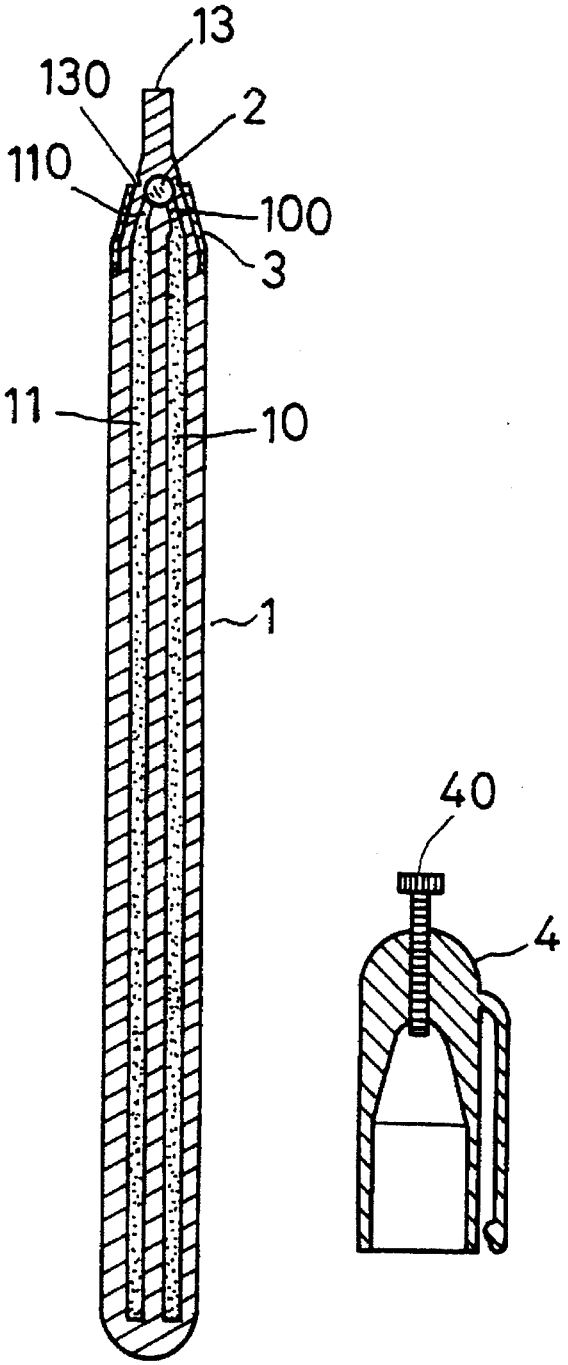
FIG. 2 is a cross-sectional view of a completed light-emitting ball-point pen according to the present invention.

A light-emitting ball-point pen in the present invention, as shown in FIG. 2, comprises a pen body 1, two tubes 10, 11 filled respectively with a chemical solution and located in the pen body I, outlet apertures 100, 110 respectively in the front end of the two tubes 10, 11, a steel ball 2 fitted in a front opening 12 and closely contacting with the two outlet apertures 100, 110 of the two tubes 10, 11, a ball protector 13 fused with the front end of the pen body 1 and having an annular jointed portion 130 around a third of the steel ball 2 so as to be broken easily, a hard collar 3 fitted around a section of the front portion for preventing the ball 2 from falling out of the front opening 12, and a cap 4 covering the front portion of the pen body 1 and having a screw 40 screwing in a front center to its interior.

Figure 1:
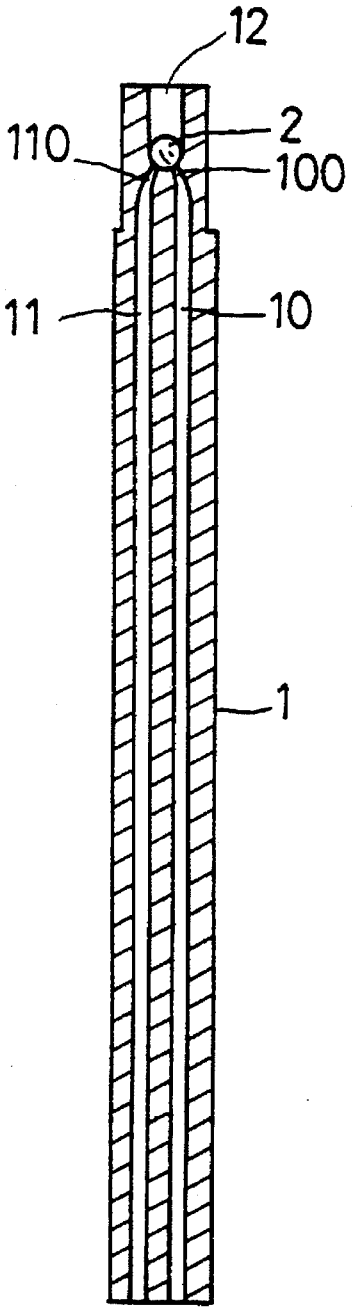
FIG. 1 is a cross-sectional view of a light-emitting ball-point pen according to the present invention, showing it in an unfinished condition.
Figure 3:
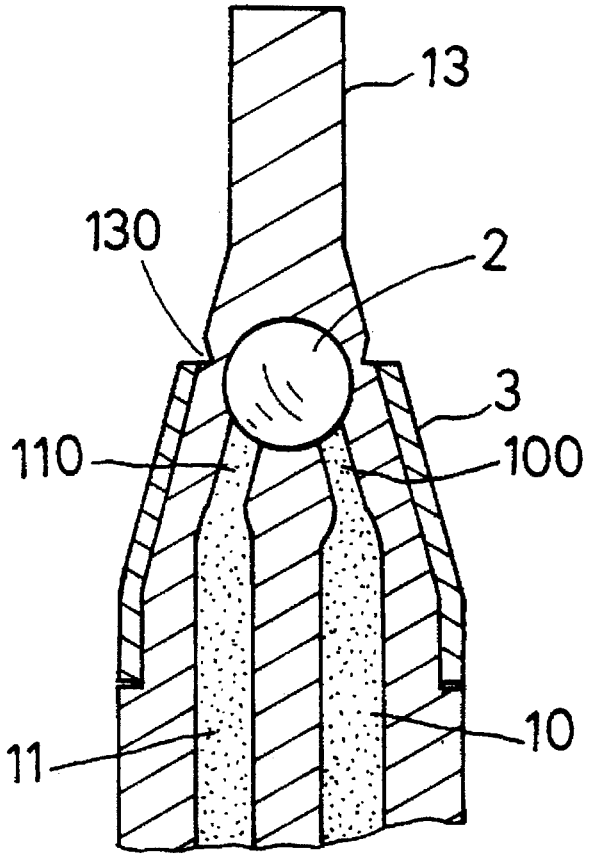
FIG. 3 is a magnified cross-sectional view of the from end portion of the light-emitting ball-point pen according to the present invention.

In assembling, referring to FIGS. 1 and 2, the ball 2 is firstly placed in the front opening 12, letting the ball 2 contact the outlet apertures 100, 110. Then the opening 12 is made to tightly catch the ball 2 by means of fusing process, and the ball protector 13 is placed and fused with the front end, covering the ball 2 and forming the annular jointed portion 130 as shown in FIG. 3. After that the hard collar 3 is fitted tightly around the a section of the front portion of the pen body 1, and lastly chemical solutions such as oxalic acid and hydrogen peroxide are respectively filled in the two tubes 10, 11 from the rear ends and then the rear ends are closed up by a heating, finishing assembling process.

Figure 4:
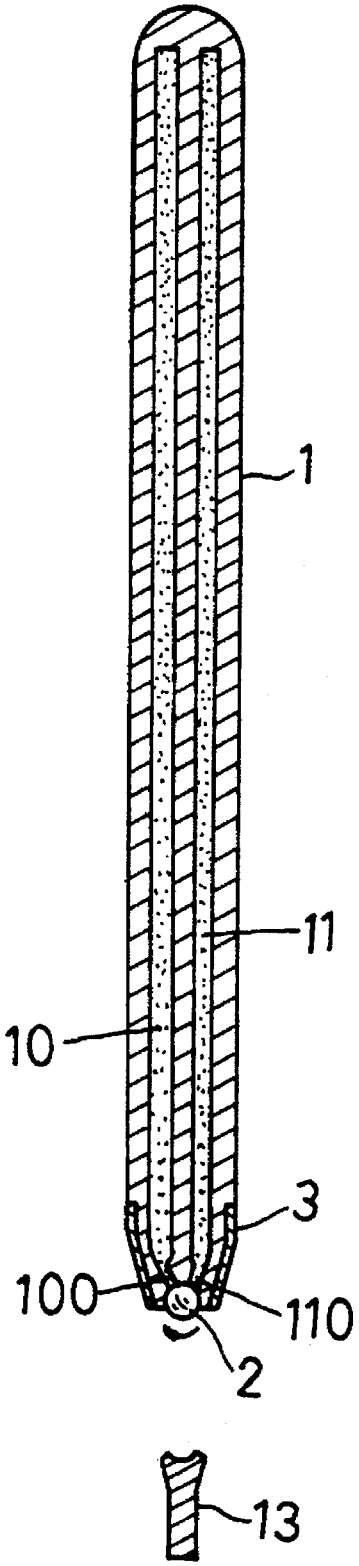
FIG. 4 is a cross-sectional view of the light-emitting ball-point pen according to the present invention, showing it ready for writing.
Figure 5:
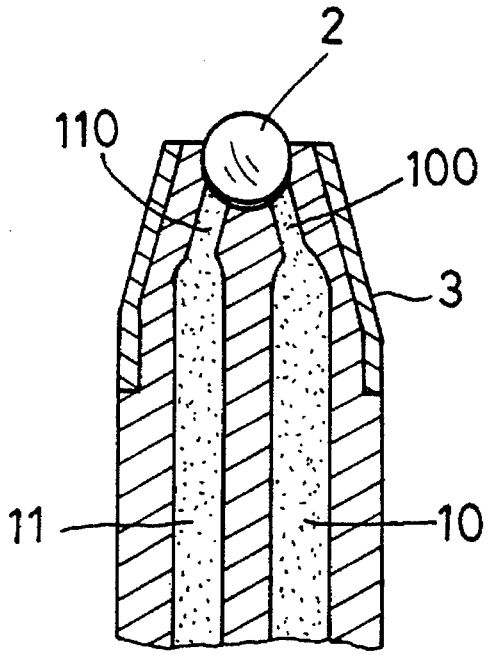
FIG. 5 is a magnified cross-sectional view of the front end portion of the light-emitting bail-point pen of the present invention, showing it in a writing condition.
Figure 6:
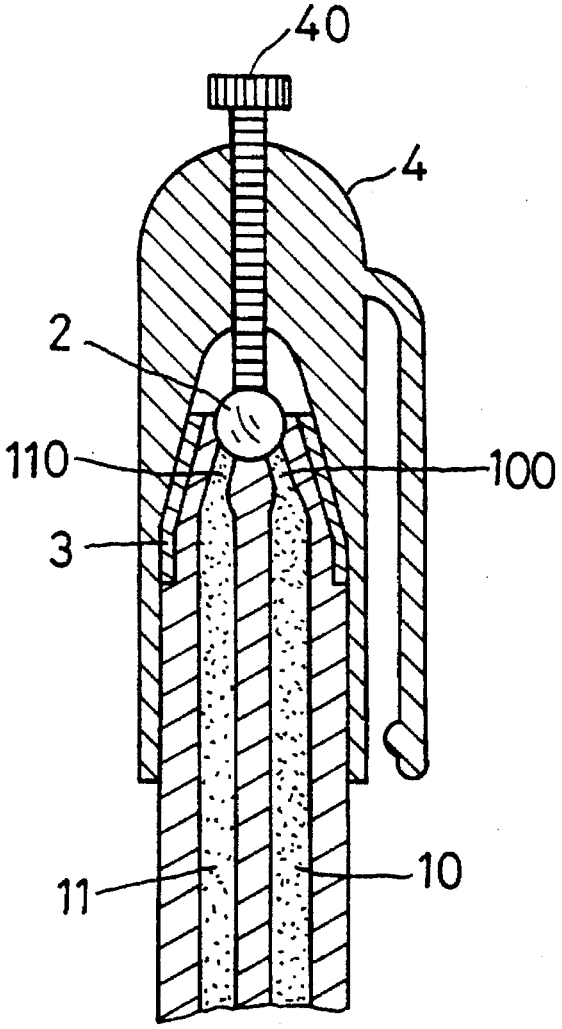
FIG. 6 is a magnified cross-sectional view of the front end portion covered with a cap according the present invention.

In using, referring to FIGS. 4 and 5, at first, the protector 13 is broken off the pen body 1, with the annular jointed portion 130 allowing easy separation from the pen body 1. The ball 2 rotates during writing, forcing the chemical solutions in the two tubes 10, 11 to evenly flow out with rotation of the ball 2 and mixing with each other to emit light at the same time. So if this ball pen is used in the night or under a dim light, it gives off light, enabling a writer write clearly or read clearly what is being written, and additionally augmenting interest of the user. The screw 40 of the cap 4 can be screwed down to press the ball 2 when the cap covers the front end of the pen body 1, preventing the chemical solutions from leaking out of the tubes 10, 11.

A few advantages of the present invention can be realized in the above description.

1. In the night, in a dark place or under a dim light, it can be used to write clearly without a bright light.

2. It can increase interest in writing.

3. The chemical solutions cannot accidentally flow out of the pen.

What is claimed is:

1. A light emitting ball point pen comprising:

a) a pen body having at least two tubes containing chemical solutions which when mixed together give off light, each tube having an outlet aperture, the pen body having a front end having a front opening in communication with the outlet apertures of the at least two tubes;

b) a steel ball rotatably mounted in the front opening such that rotation of the ball allows the chemical solutions to flow out of the tubes and mixes the chemical solution together;

c) a cap removably engaging the pen body so as to cover the front end including the steel ball the cap having an interior opening to accommodate the front end of the pen body; and, d) a screw adjustment member threadingly engaged with and extending through the cap such that a portion of the screw adjustment member extends into the interior opening and bears against the steel ball to cause the steel ball to seal the outlet apertures of the at least two tubes to prevent leakage of the chemical solutions.

2. The light-emitting ball-point pen as claimed in claim 1, further comprising a protector fused together with the front end of the pen body by means of an annular jointed portion and covering a portion of the steel ball before said ball-point pen is used.

3. The light-emitting ball-point pen as claimed in claim 1 further comprising a hard collar attached to the front end of said pen body to reinforce the pen body.

* * * * *